US005158715A

United States Patent [19]

Jäger

[11] Patent Number: 5,158,715

[45] Date of Patent: Oct. 27, 1992

[54] APPARATUS FOR AERATING WATER

[76] Inventor: Arnold Jäger, Gehrbergsweg 6, 3167 Burgdorf, Fed. Rep. of Germany

[21] Appl. No.: 717,697

[22] Filed: Jun. 19, 1991

[30] Foreign Application Priority Data

Jun. 19, 1990 [DE] Fed. Rep. of Germany ... 9006868[U]

[51] Int. Cl.[5] ..... B01F 3/04

[52] U.S. Cl. ..... 261/122.1

[58] Field of Search ..... 261/122

[56] References Cited

U.S. PATENT DOCUMENTS

| | | | |
|---|---|---|---|
| 1,792,286 | 2/1931 | Curry et al. | 261/122 |
| 4,269,797 | 5/1981 | Mikiya et al. | 261/122 |
| 4,488,508 | 12/1984 | Heideman | 261/122 |
| 4,495,114 | 1/1985 | Strauss | 261/122 |
| 4,624,781 | 11/1986 | Messner | 261/122 |
| 4,734,191 | 3/1988 | Schussler | 261/122 |
| 5,000,884 | 3/1991 | Bassfeld | 261/122 |
| 5,015,421 | 5/1991 | Messner | 261/122 |

FOREIGN PATENT DOCUMENTS

| | | | |
|---|---|---|---|
| 54-153317 | 12/1979 | Japan | 261/122 |

*Primary Examiner*—Tim Miles

*Attorney, Agent, or Firm*—Robert W. Becker & Associates

[57] ABSTRACT

An apparatus for aerating water, including a rigid, at least essentially planar support element upon which is disposed a sheet of elastomeric material that is provided with fine slits for the discharge of air. The support element has one or more connectors for supplying air between the support element and the sheet. The rim portion of the sheet is connected in an airtight manner to the support element. Provided at various locations inwardly of the rim portion of the sheet are one or more holding mechanisms for limiting or preventing a lifting of the sheet from the support element. This holding mechanism is in the form of a projection that is disposed on the underside of the sheet and is connected to the support element in an interlocking and/or frictional manner.

12 Claims, 1 Drawing Sheet

APPARATUS FOR AERATING WATER

BACKGROUND OF THE INVENTION

The present invention relates to an apparatus for aerating water, and includes a rigid, at least essentially planar support element upon which is disposed a sheet made of rubber or other elastomeric material, with this sheet being provided with fine slits for the discharge of air. The support element has one or more connectors for supplying air between the support element and the sheet, with the rim portion of the sheet being connected in an air tight manner to the support element. At least one holding means is disposed at various locations inwardly of the rim portion of the sheet for limiting or preventing a lifting or raising of the sheet from the support element when the sheet is subjected to internal pressure.

With the heretofore known apparatus of this type, threaded bolts or metal strips that are bolted on are provided that extend through the sheet and the support element. Aside from the fact that these known holding means require a not inconsiderable amount of time and effort for assembly, they do not even ensure that no air can escape or leak out.

It is therefore an object of the present invention to improve an apparatus of the aforementioned general type in such a way that a simple and rapid assembly is possible, while at the same time an airtight configuration is ensured.

BRIEF DESCRIPTION OF THE DRAWING

This object, and other objects and advantages of the present invention, will appear more clearly from the following specification in conjunction with the accompanying drawing, in which.

SUMMARY OF THE INVENTION

Figure 1:
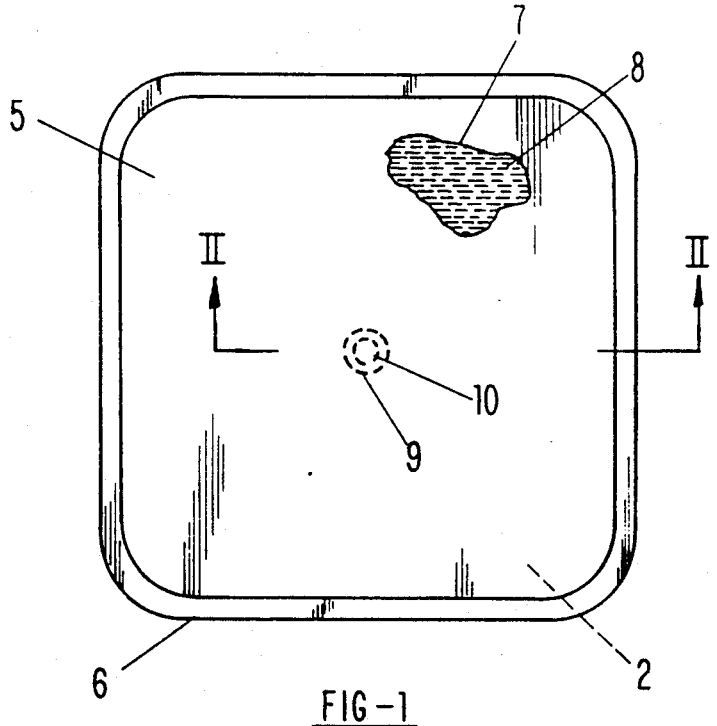
FIG. 1 is a top view of one exemplary embodiment of the inventive apparatus for aerating water, with the apparatus having an essentially square shape.

The apparatus of the present invention is characterized primarily in that the holding means is in the form of a projection that is integrally formed or otherwise secured to the underside of the sheet, with this projection preferably being made of the same elastomeric material as is the sheet, and with this projection being connected to the support element in an interlocking and/or frictional manner. This projection is expediently embodied in such a way that it can engage the support element in the manner of a push button or snap fastener, with the projection advantageously being provided with a widened head portion that can be pressed through a hole of the support element so that in the assembled condition it prevents or at least limits a lifting of the sheet away from the support element. In this connection, the shaft of the projection that leads to the thickened head portion can be slightly thicker than the hole of the support element so that the shaft could also be disposed with stress, i.e. compressive forces, within this hole.

The projection is thus sealed relative to the support element, and in addition, it is merely necessary to execute a press-in movement in order to complete assembly of the sheet upon the support element.

Further specific features of the present invention will be described in detail subsequently.

DESCRIPTION OF PREFERRED EMBODIMENTS

Referring now to the drawing in detail, the aerator is disposed horizontally in the water and is fed via a common line to which the apparatus of the present invention is connected. This connection is effected via a downwardly directed connector 1 of a rigid, essentially flat or panel-like carrier or support element 2; a tube, hose, or the like is connected to the connector 1.

The support element 2 is a molded plastic element; the rim of the support element is thickened, and in particular by a rib 3 that extends all the way around. Disposed on the rim 4 of the support element 2 is a rubber sheet 5 that covers the support element 2, with the sheet 5 being flush with the support element 2 at the sides. The rim of the sheet 5 is pressed against the rim 4 of the support element 2 by a band or strip 6 that is placed upon the support element 2 and extends all the way around; the strip 6 can be connected to the support element 2 by being screwed or otherwise fastened thereto. The important thing is that an airtight connection is obtained. Consequently, a different type of connection of the rim of the sheet 5 can also be utilized. For example, the rim of the sheet 5 could also extend about the support element 2. It is to be understood that by introducing compressed air into the connector 1, air passes between the support element 2 and the sheet 5.

With the exception of a central portion and the rim region, the sheet 5, as can be seen from the cutaway portion 7, is provided with fine slits 8 that extend all the way through. These slits 8 open under the influence of internal pressure and allow fine air bubbles to enter the water; however, the slits 8 close again when the internal pressure decreases.

Figure 2:
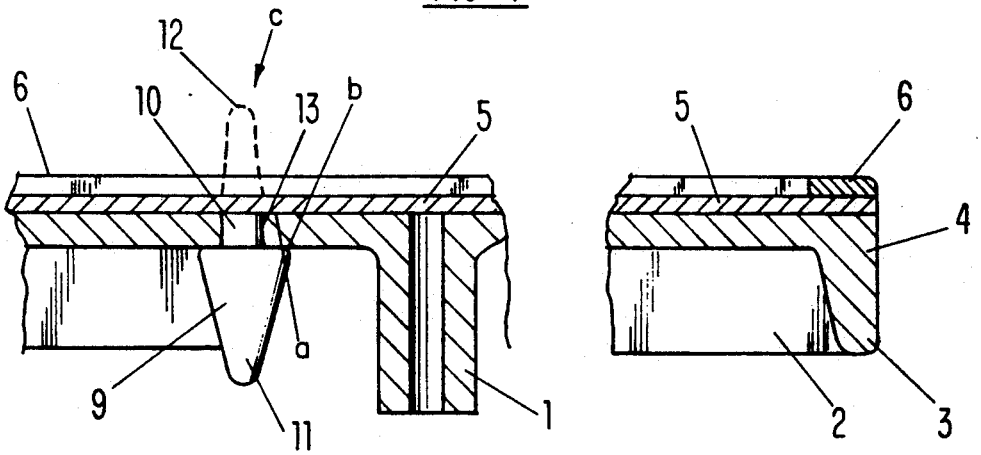
FIG. 2 is a partial cross-sectional view taken along the line II—II in FIG. 1.

Provided in the central portion of the apparatus is a projection 9 that is formed on the underside of the sheet 5, in other words, is made of the same material as is the sheet 5 (namely rubber or some other elastomeric material). The projection 9 extends perpendicularly downwardly from the sheet 5, and is provided with a cylindrical shaft 10 and at the free end a widened portion 11 that tapers downwardly in a conical fashion. The projection 9 extends through a hole 13 of the support element 2. In this connection, the diameter of the shaft 10 is such that it is compressed slightly within the hole 13. In addition, the length of the shaft 10 is slightly less than the thickness of the support element 2. This results in a corresponding pressure against the support element 2 as shown by the reference symbols "a" and "b" in FIG. 2.

As indicated by dashed lines and by the reference symbol "c", it is also possible to provide a projection 12 on the upper side of the sheet 5 at a location opposite the projection 9. This further projection 12 provides not only an indicator, but also possibly a handgrip for the introduction of the projection 9 into the hole 13 or for a withdrawal of the projection 9 therefrom.

Assembly is effected by pressing the projection 9 into the hole 13 in the manner of push button or snap fastener; after the projection 9 has been introduced into the hole 13, it can also be pulled from below.

The inventive holding mechanism prevents the sheet 5 from bulging out too much under the effect of the internal pressure. It is to be understood that depending upon the size and shape of the apparatus, further such holding mechanisms can be provided.

Figure 3:
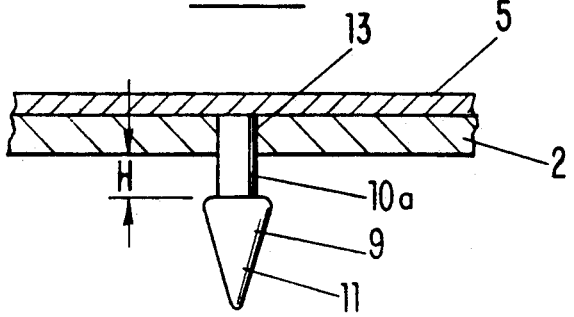
FIG. 3 is a vertical cross-sectional view similar to that of FIG. 2 showing a modified holding means for limiting the lifting movement of the sheet.

In the embodiment illustrated in FIG. 3, the shaft 10*a* is longer than the thickness of the support element 2. This provides for a limited axial movement of the shaft 10*a*, and hence a limited lifting of the sheet 5 when an internal pressure exists. A sealing effect is also provided with this embodiment via a resilient compression that is established in the projection 9, i.e. the shaft 10*a* thereof, and that effects a complete engagement against the support element 2. The amount of lifting that is possible by the sheet 5 is designated by the reference symbol H.

The present invention is, of course, in no way restricted to the specific disclosure of the specification and drawings, but also encompasses any modifications within the scope of the appended claims.

What I claim is:

1. An apparatus for aerating water, comprising:

a rigid, at least essentially planar, panel-like support element;

a sheet made of elastomeric material, with said sheet being disposed on said support element and being provided with fine slits for the discharge of air;

at least one connector disposed on said support element for supplying air between said support element and said sheet;

means for connecting a rim portion of said sheet in an airtight manner to said support element; and at least one holding means disposed inwardly of said rim portion of said sheet for limiting a lifting of said sheet from said support element in the vicinity of said holding means, with said holding means being in the form of a projection that is disposed on a side of said sheet that faces said support element, with said projection being positively connected to said support element, and with said projection being integrally formed on said sheet and being made of the same elastomeric material as is said sheet.

2. An apparatus for aerating water, comprising:

a rigid, at least essentially planar, panel-like support element;

a sheet made of elastomeric material, with said sheet being disposed on said support element and being provided with fine slits for the discharge of air;

at least one connector disposed on said support element for supplying air between said support element and said sheet;

means for connecting a rim portion of said sheet in an airtight manner to said support element; and at least one holding means disposed inwardly of said rim portion of said sheet for limiting a lifting of said sheet from said support element in the vicinity of said holding means, with said holding means being in the form of a projection that is disposed on a side of said sheet that faces said support element, with said projection being positively connected to said support element, and with said projection being connected to said support element in the manner of a snap fastener.

3. An apparatus for aerating water, comprising:

a rigid, at least essentially planar, panel-like support element;

a sheet made of elastomeric material, with said sheet being disposed on said support element and being provided with fine slits for the discharge of air;

at least one connector disposed on said support element for supplying air between said support element and said sheet;

means for connecting a rim portion of said sheet in an airtight manner to said support element; and at least one holding means disposed inwardly of said rim portion of said sheet for limiting a lifting of said sheet from said support element in the vicinity of said holding means, with said holding means being in the form of a projection that is disposed on a side of said sheet that faces said support element, with said projection being positively connected to said support element, and with said projection including a shaft that is connected to said sheet and extends through a hole of said support element, with said shaft, remote from said sheet, having a widened portion that forms a free end of said projection.

4. An apparatus according to claim 3, in which said projection is fixedly secured to said sheet.

5. An apparatus according to claim 3, in which said shaft is longer than a thickness of said support element to permit a certain free movement of said sheet.

6. An apparatus according to claim 3, in which said shaft has a diameter that essentially corresponds to the diameter of said hole.

7. An apparatus according to claim 3, in which said shaft has a diameter that is slightly greater than the diameter of said hole.

8. An apparatus according to claim 3, in which said shaft has a length that is slightly less than a thickness of said support element.

9. An apparatus according to claim 3, in which said widened portion of said shaft tapers in a direction toward said free end of said projection.

10. An apparatus according to claim 9, in which the least diameter of said tapered portion is less than the diameter of said hole of said support element.

11. An apparatus according to claim 3, in which said sheet, on a side thereof remote from said support element, and essentially opposite said first-mentioned projection, is provided with a further projection.

12. An apparatus according to claim 11, in which said further projection is in the form of a handgrip.

* * * * *